US010954707B2

(12) United States Patent
Hailey et al.

(10) Patent No.: US 10,954,707 B2
(45) **Date of Patent: *Mar. 23, 2021**

(54) DOOR SYSTEM WITH SLIDING AND HINGING CAPABILITY

(71) Applicant: FRENCH SLIDE LLC, Richmond, VA (US)

(72) Inventors: Neil Adair McMillan Hailey, Richmond, VA (US); Matthew Joseph Sozio, Rochester, NY (US)

(73) Assignee: FRENCH SLIDE LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/444,853

(22) Filed: Jun. 18, 2019

(65) Prior Publication Data

US 2019/0301217 A1 Oct. 3, 2019

Related U.S. Application Data

(63) Continuation of application No. 16/134,265, filed on Sep. 18, 2018, now Pat. No. 10,415,289, which is a (Continued)

(51) Int. Cl.

| | |
|---|---|
| ***E05D 15/58*** | (2006.01) |
| ***E05D 15/48*** | (2006.01) |
| ***E06B 3/50*** | (2006.01) |

(52) U.S. Cl.

CPC ..... *E05D 15/58* (2013.01); *E05D 15/48* (2013.01); *E05D 15/581* (2013.01); *E06B 3/50* (2013.01);

(Continued)

(58) Field of Classification Search

CPC ..... E05D 15/48; E05D 15/58; E05D 15/581; E06B 3/5072

See application file for complete search history.

(56) References Cited

U.S. PATENT DOCUMENTS

| | | | |
|---|---|---|---|
| 704,887 | A | 7/1902 | Low |
| 3,318,047 | A | 5/1967 | Carson |

(Continued)

FOREIGN PATENT DOCUMENTS

| | | | |
|---|---|---|---|
| DE | 102012210594 A1 | 12/2013 | |
| EP | 1918495 A2 * | 5/2008 | ..... E05D 15/0604 |

(Continued)

OTHER PUBLICATIONS

U.S. Appl. No. 16/134,265, dated Jan. 4, 2019, 10 pages.
PCT/US2018/047369, International Search Report, dated Apr. 12, 2018, 2 pages.

*Primary Examiner* — Marcus Menezes
(74) *Attorney, Agent, or Firm* — Nixon Peabody LLP; Matthew Kitces

(57) ABSTRACT

A door assembly is provided for which can alternate between a pivoting and a sliding configuration. The door assembly can include a door panel, a track, a first carriage assembly, a second carriage assembly, and a locking mechanism. The first and second carriage assembly can connect the door panel to the track. The first and second carriage assemblies can be slidably movable on the track, and the first carriage assembly can further include a pivot mechanism that pivotably couples the door to the track. The locking mechanism can configure the door between the sliding and pivoting configurations. For example, the locking mechanism can mechanically couple the door panel to the second carriage assembly in the sliding configuration and mechanically decouple the door from the second carriage assembly in the pivoting configuration.

14 Claims, 18 Drawing Sheets

Related U.S. Application Data continuation of application No. PCT/US2018/047369, filed on Aug. 21, 2018.

(60) Provisional application No. 62/548,041, filed on Aug. 21, 2017.

(52) U.S. Cl.
CPC ..... *E06B 3/5072* (2013.01); *E05D 2015/485* (2013.01); *E05D 2015/588* (2013.01); *E05Y 2900/132* (2013.01); *E05Y 2900/15* (2013.01)

(56) References Cited

U.S. PATENT DOCUMENTS

| | | | | |
|---|---|---|---|---|
| 3,354,581 | A | 11/1967 | Kessner | |
| 5,832,980 | A | 11/1998 | Cianciolo | |
| 6,422,287 | B1 | 7/2002 | Wilke | |
| 6,618,994 | B1 * | 9/2003 | Nussbaum | E05B 53/003 292/171 |
| 7,412,800 | B2 | 8/2008 | Maier | |
| 7,861,475 | B2 * | 1/2011 | Sprague | E04B 2/827 160/196.1 |
| 7,950,439 | B2 | 5/2011 | Anderson | |
| 8,381,443 | B2 * | 2/2013 | Smith | E05D 15/48 49/141 |
| 8,443,549 | B2 * | 5/2013 | Salvietti | E05D 15/48 49/118 |
| 8,567,126 | B2 | 10/2013 | Hozumi et al. | |
| 8,627,604 | B2 * | 1/2014 | Seymour | E05D 15/58 49/141 |
| 8,756,864 | B2 | 6/2014 | Hamaker et al. | |
| 8,806,807 | B2 * | 8/2014 | Rees | E05D 15/48 49/130 |
| 8,819,993 | B1 | 9/2014 | Chen | |
| 8,925,248 | B2 | 1/2015 | Maruyama et al. | |
| 8,991,099 | B1 | 3/2015 | Erskine | |
| 9,194,172 | B2 * | 11/2015 | Rees | E05D 15/58 |
| 9,637,970 | B1 * | 5/2017 | Rendon, Jr. | E06B 3/509 |
| 10,415,289 | B2 * | 9/2019 | Hailey | E06B 3/5072 |
| 2002/0163284 | A1 | 11/2002 | Levy et al. | |
| 2007/0068080 | A1 | 3/2007 | Vigdorovich et al. | |
| 2010/0107499 | A1 | 5/2010 | Kuhnmuench | |
| 2012/0000129 | A1 | 1/2012 | Kuznetsov | |
| 2014/0083013 | A1 * | 3/2014 | Nicholson | E05D 15/48 49/177 |
| 2014/0352220 | A1 * | 12/2014 | Rees | H04L 12/4633 49/164 |
| 2015/0075075 | A1 | 3/2015 | Erskine | |
| 2016/0251885 | A1 * | 9/2016 | Conley | E06B 3/924 49/127 |

FOREIGN PATENT DOCUMENTS

| | | | | |
|---|---|---|---|---|
| GB | 490890 | A * | 8/1938 | E06B 3/924 |
| WO | WO-2011112408 | A1 | 9/2011 | |

* cited by examiner

DOOR SYSTEM WITH SLIDING AND HINGING CAPABILITY

CROSS REFERENCE TO RELATED APPLICATIONS

This application is a continuation, which claims priority to U.S. Non-Provisional application Ser. No. 16/134,265 entitled, "Door System with Sliding and Hinging Capability", filed Sep. 18, 2018. This application is also a bypass continuation of International Application No.: PCT/US18/47369, filed Aug. 21, 2018, entitled, "Door System with Sliding and Hinging Capability," the contents of which are incorporated herein by reference. This application also claims priority to U.S. Provisional Application No. 62/548,041, filed Aug. 21, 2017, entitled, "Design and Apparatus for Entryway Door System With Sliding and Hinging Capability," the contents of which are herein incorporated by reference in their entirety.

FIELD

The present invention relates to a door system, and more specifically, to a door system with sliding and hinging capabilities.

BACKGROUND

Traditional two-panel patio doors typically offer either fixed-axis rotation (swinging) or lateral movement (sliding). Swinging patio doors can maximize space for ingress and egress but they do not allow for any variability in the size of an opening between the interior and the exterior. Additionally, swinging patio doors provide insufficient pressure resistance from wind, air, and water because of the seam between the two doors. Sliding patio doors can vary the size of an opening between the interior and the exterior. Sliding patio doors can also be configured to overlap with each other to make the doors less prone to air pressure fluctuations and water entry. However, sliding patio doors typically offer approximately half of the space for ingress and egress as swinging patio doors.

Some patio door systems attempt to accomplish both sliding and swinging functionality but rely on complex hinging mechanisms or complicated hardware, such as motorized systems. Other patio door systems attempt to provide flexibility with multiple panels allowing for various configurations; however, the designs can be confusing and cumbersome for users due to requiring multiple sliding and lifting motions to open and close the panels as desired.

Therefore, there is a need for a patio door system which provides both fixed-axis rotation and lateral movement. Such a door system should be intuitive for the user to operate, allow variability in the size of an opening between the interior and the exterior, and maximize an available opening space for ingress and egress.

SUMMARY

The present disclosure provides for a door assembly comprising a door, a first track, a first carriage assembly, a second carriage assembly, and a first locking mechanism. The first carriage assembly can be slidably moveable on the first track and include a first pivot mechanism, which pivotably couples the door to the first track. The second carriage assembly can also be slidably movable on the first track. The first locking mechanism can configure the door in either a sliding configuration or a pivoting configuration. In particular, the first locking mechanism can mechanically couple the door to the second carriage assembly in the sliding configuration and mechanically decouple the door from the second carriage assembly in the pivoting configuration.

In some examples, the first pivot mechanism can include a hinge pin which pivotably couples the first carriage mechanism and the door. For example, the hinge pin can extend between the first carriage mechanism and the door. The door assembly can further include a mounting bracket mechanically coupled to the door. The mounting bracket can further include a pin connector for receiving the hinge pin.

In some examples, a second locking mechanism is provided that can selectively fix a position of the first carriage assembly in the first track. The second locking mechanism can be positioned above the first track. The second locking mechanism can include a rod for fixing the position of the first carriage assembly and a linear motion device for positioning the rod for either the sliding configuration or the pivoting configuration. The linear motion device can position the rod to extend through the first track and the first carriage assembly to lock the first carriage assembly in place for the pivoting configuration. The linear motion device can position the rod so as to be retracted from the first carriage assembly for the sliding configuration. This second locking mechanism can be manually operated.

Similar to the second locking mechanism, the first locking mechanism can also include a rod and a linear motion device for positioning the rod for either the sliding configuration or the pivoting configuration. In a sliding configuration, the linear motion device can position the rod to extend through the door and the second carriage assembly. In a pivoting configuration, the linear motion device retracts the rod from the second carriage assembly for the pivoting configuration.

In some examples, the second carriage assembly can further include a striker extending towards the door from a base of the second carriage assembly. The door assembly can further include a set of detents on the door. The detents can be positioned and shaped to receive the striker and thereby couple the door to the second carriage assembly. The second carriage assembly can thereby secure the striker for the sliding configuration.

In some examples, the first locking mechanism can be integrated into the door, and can optionally be manually operated.

In some examples, the door assembly can further include a second track and a third carriage assembly. The third carriage assembly can be slidably movable on the second track and can include a second pivot mechanism. The second pivot mechanism can pivotably couple the door to the second track. The second pivot mechanism and the first pivot mechanism can be configured to operate cooperatively.

In some examples, the door assembly can further include a third locking mechanism configured to fix a position of the third carriage assembly in the second track.

In some examples, the door assembly can further include a fourth carriage assembly and a fourth locking mechanism. The fourth carriage assembly can be slidably movable on the second track. The fourth locking mechanism can mechanically couple the door to the fourth carriage assembly in the sliding configuration and mechanically decouple the door from the fourth carriage assembly in the pivoting configuration.

In some examples, the third locking mechanism and the second locking mechanism can operate together. In some examples, the fourth locking mechanism and the first locking mechanism can operate together.

DETAILED DESCRIPTION

Figure 1A:
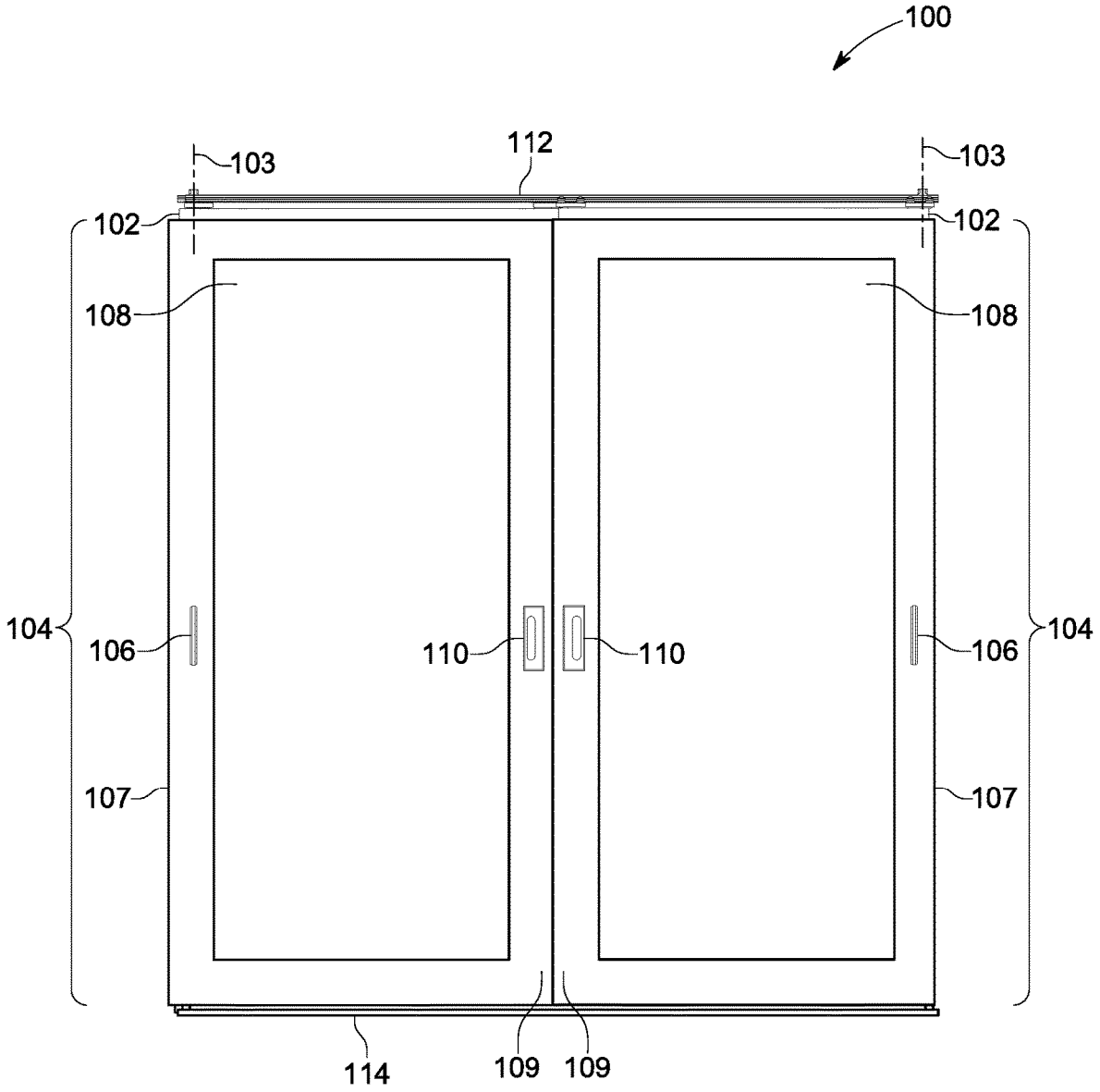
FIG. 1A shows a schematic of an exemplary door apparatus, in accordance with an embodiment of the present disclosure.

The present invention is described with reference to the attached figures, where like reference numerals are used throughout the figures to designate similar or equivalent elements. The figures are not drawn to scale and are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details, or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

The present disclosure relates to a door assembly comprising at least a first and second door. Each door can be connected to an upper track via first and second carriage assemblies. The first carriage assembly of each door can be configured to optionally pivot or slide along the upper track. The second carriage assembly of each door can be configured to allow each door to optionally engage or disengage with the upper track, depending on whether the first carriage assembly is configured to slide or pivot. Therefore, the present disclosure provides a door assembly with fixed-axis rotation where the door assembly can pivot about the first carriage assembly. The same door assembly can be configured for lateral movement of both doors.

Figure 1B:
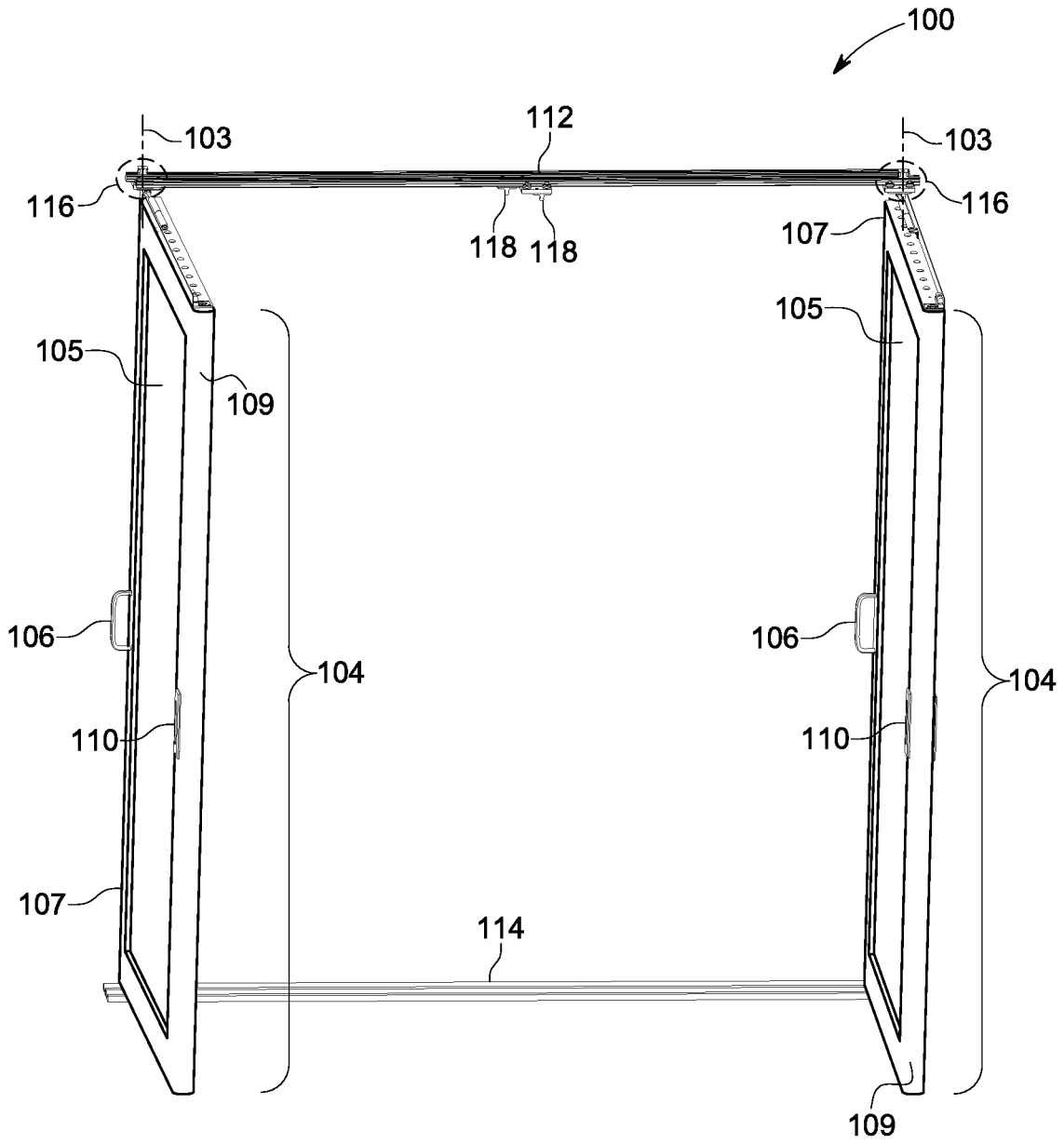
FIG. 1B shows swinging capabilities of an exemplary door apparatus, in accordance with an embodiment of the present disclosure.
Figure 1C:
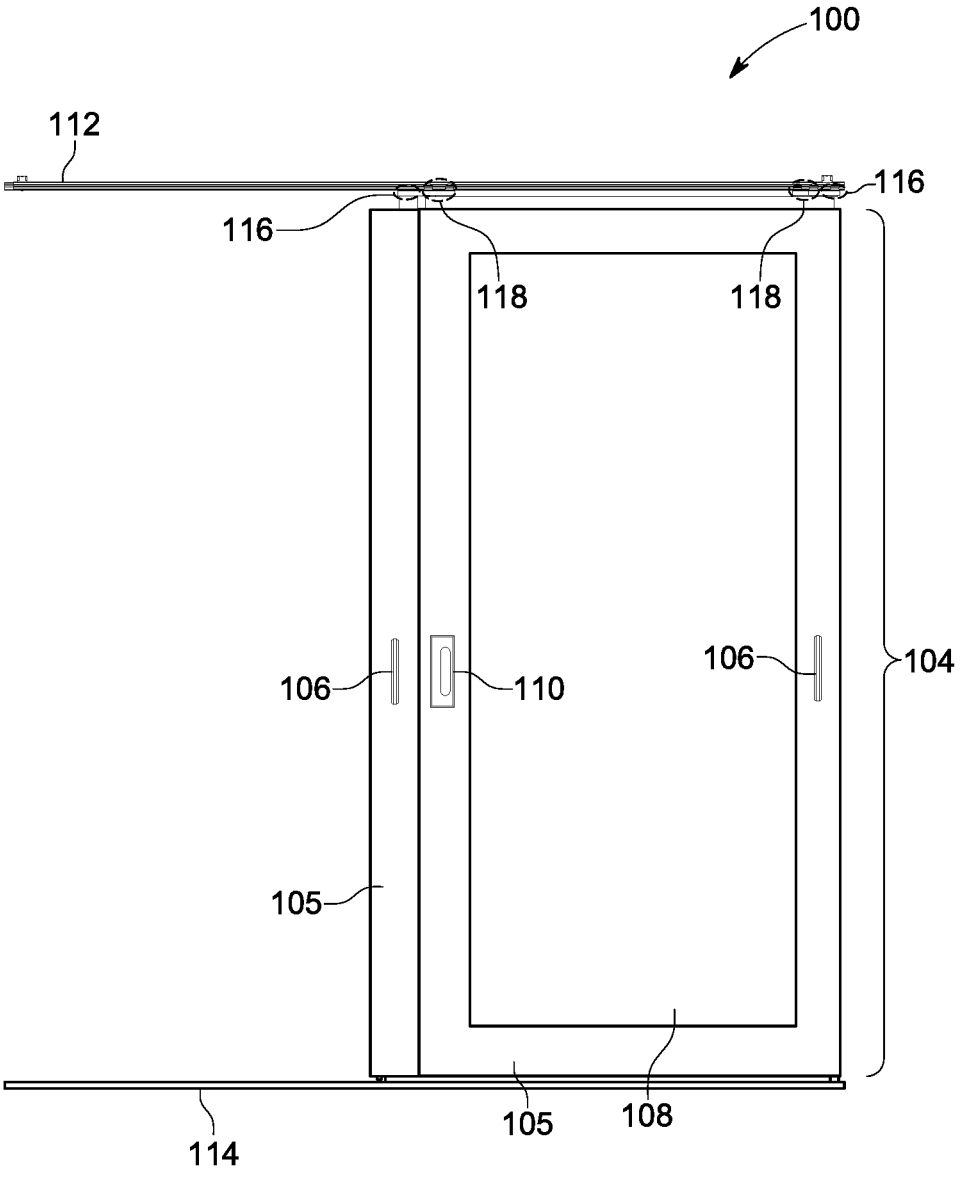
FIG. 1C shows sliding capabilities of an exemplary door apparatus, in accordance with an embodiment of the present disclosure.

FIGS. 1A-1C show an exemplary door assembly 100 according to a first embodiment of the present disclosure. Although various descriptions of the components are included below, an exemplary door assembly might not include all components and, in some cases, can include additional components. For example, although two doors are shown in FIGS. 1A-1C, the present disclosure can also contemplate more than two doors. Door assembly 100 can include mounting brackets 102; door panels 104; door frames 105; first handles 106; light transmitting panes 108; second handles 110; an upper track 112; a lower track 114; pivoting carriage assemblies 116; and sliding carriage assemblies 118.

FIG. 1A shows a front-facing view of door assembly 100. In particular, FIG. 1A illustrates how door assembly 100 can have two door panels 104 which are connected to an upper track 112 and a lower track 114. Each door panel 104 can comprise a door frame 105 with an interior edge 109 and an exterior edge 107, a first handle 106, and a second handle 110. Door frame 105 can be constructed out of wood, metal, or any other materials or combination of materials suitable for construction of a door assembly. First handles 106 can be located near an exterior edge 107 of each of door frames 105, where a user can grasp handle 106 to slide door panel 104 along upper track 112 and lower track 114. First handles 106 can be pull-style handles, inlaid with the door frame 105. Alternatively, first handles 106 can also be pocket handles.

Second handles 110 can be located near an interior edge 109 of each of door frames 105 and allow a user to pull door panel 104 open, thus permitting pivoting of each door panel 104 about an axis 103. In some implementations, second handles 110 can be pocket-type handles. Door panels 104 can also optionally include a light transmitting pane 108 to allow exterior light to enter an interior room. The light transmitting pane 108 can be glass, plastic, or any material or combination of materials that transmit light. Further, light transmitting pane 108 can have any level of opaqueness. For example, the light transmitting pane 108 can be transparent, partially opaque, or a combination of transparent portions and opaque and/or partially opaque portions. Door panels 104 can further be connected to upper track 112 via respective mounting brackets 102. Each mounting bracket 102 can ensure that a connected door panel 104 remains attached to upper track 112 when sliding or pivoting.

FIG. 1B shows a front-facing view of door assembly 100 where both door panels 104 are configured to pivot open about axis 103. FIG. 1B additionally shows schematic representations of pivoting carriage assemblies 116 and sliding carriage assemblies 118. Although pivoting carriage assembly 116 can both pivot and slide, sliding carriage assembly 118 can be configured only to slide along upper track 112. In operation, door panels 104 are configured to pivot about pivoting carriage assemblies 116. To allow such pivoting, door panels 104 are uncoupled from sliding carriage assemblies 118. The configuration of pivoting carriage assemblies 116 and sliding carriage assemblies 118 will be discussed below in greater detail. FIG. 1B thus illustrates how a door assembly 100, according to an exemplary embodiment of the present disclosure, maximizes an available opening space for ingress and egress. Door panels 104 can be configured to swing freely. For example, in some implementations, door panels 104 can pivot up to 100 degrees. In general, door panels 104 can be configured to pivot freely until they hit a wall; for example, pivoting up to 180 degrees.

FIG. 1C shows how door panels 104 can be configured to slide open along upper track 112 and lower track 114. In this case, the door panels 104 are coupled to sliding carriage assemblies 118 to prevent pivoting of door panels 104 and allow only sliding thereof. In certain implementations, the door panels 104 are configured to slide to minimize space utilized. For example, a first door panel can lie flush behind a second door panel in the sliding configuration. Additionally, either door panel 104 can be configured to slide to adjacent to a remaining door panel 104. FIG. 1C thus illustrates how door assembly 100, according to an exemplary embodiment of the present disclosure, provides maximum variability for a user, where door panels 104 can be partially or entirely slid open on either side of door assembly 100.

Figure 2:
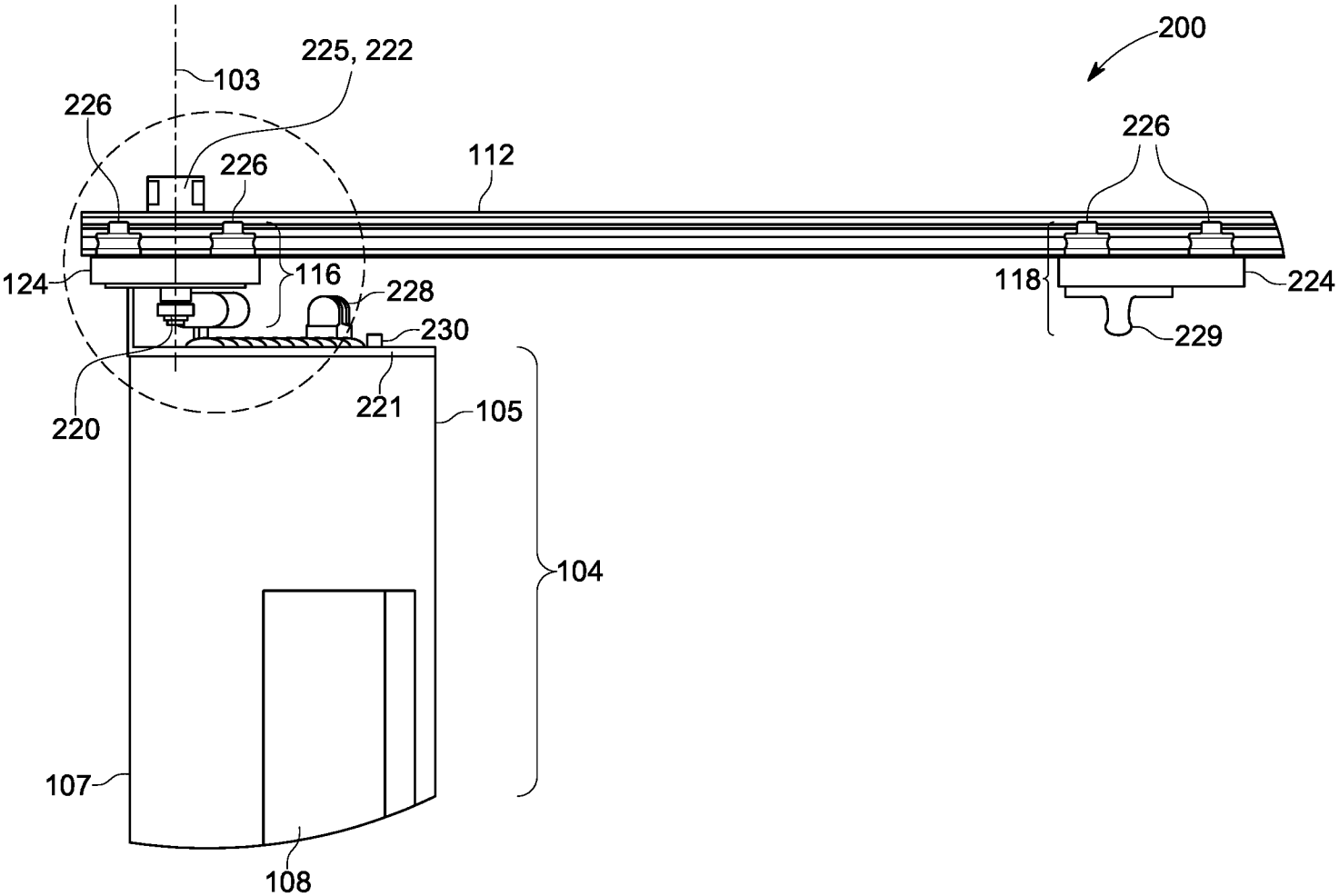
FIG. 2 shows a close-up view of an exemplary door apparatus, in accordance with an embodiment of the present disclosure.

FIG. 2 shows a close-up view of door assembly 200, according to an embodiment of the present disclosure. Assembly 200A can include similarly labeled components to door assembly 100 and can additionally include a pivot mechanism 220 coupled to pivoting carriage assembly 116; a linear motion device 222 coupled to upper track 112; carriage bases 224 for pivoting carriage assembly 116 and sliding carriage assembly 118; carriage wheels 226; a receiving element 228 coupled to door frame 105; striker 229; rods 230; and a locking mechanism 225.

As shown in FIG. 2, a pivoting carriage assembly 116 and a pivot mechanism 220 can be located near an exterior edge 107 of a door panel 104. Pivot mechanism 220 can be attached to a top portion 221 of door panel 104 and can allow door panel 104 to pivot about fixed-axis 103. Pivot mechanism 220 can connect to pivoting carriage assembly 116. Pivoting carriage assembly 116 can include a carriage base 224 and carriage wheels 226. Carriage base 224 can support the weight of door panel 104. Carriage wheels 226 can be configured to slidably move along upper track 112. Pivoting carriage assembly 116 can be configured to both pivot about a fixed axis 103 and slide along upper track 112.

FIG. 2 also shows the sliding carriage assembly 118, which includes a striker 229, carriage base 224, and carriage wheels 226. Striker 229 can be configured to connect with a receiving element 228 and optionally lock with rod 230 (discussed further with respect to FIGS. 4A-4B).

Finally, FIG. 2 also illustrates a locking mechanism 225. Locking mechanism 225 can include a linear actuator 222 and a rod 230. Rod 230 can be configured to slide through linear actuator 222 according to whether pivoting carriage assembly 116 is configured to slide along upper track 112 or pivot open along fixed axis 103 (discussed further with respect to FIGS. 3B-3C).

Figure 3A:
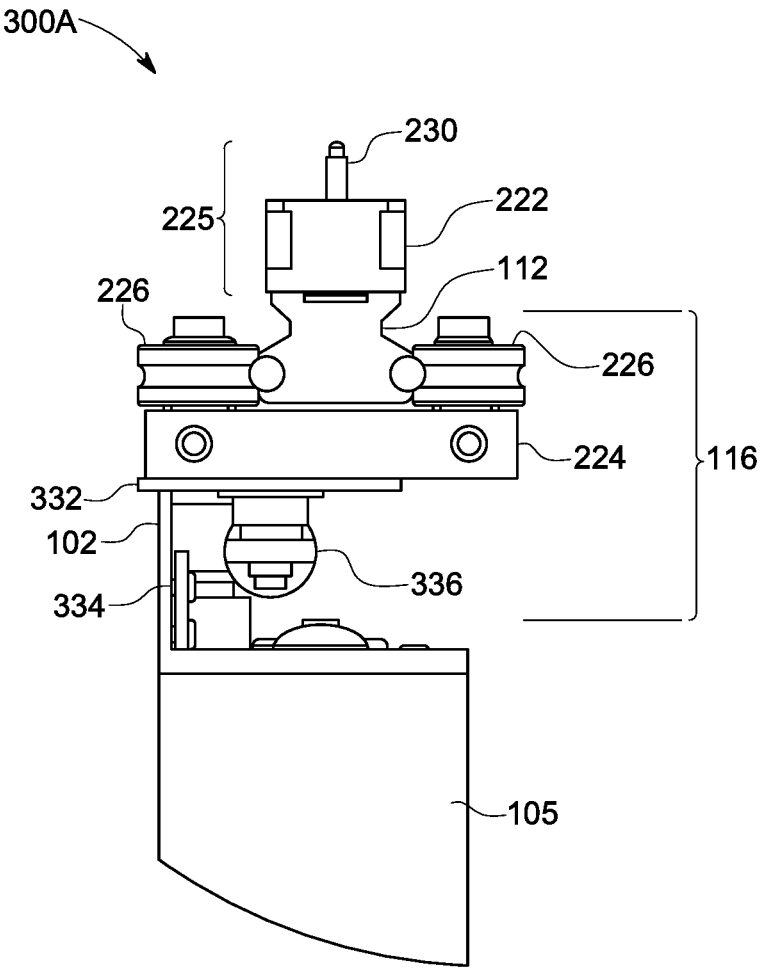
FIG. 3A shows a close-up view of an exemplary first carriage assembly of FIG. 2, in accordance with an exemplary embodiment of the present disclosure.

FIG. 3A shows a detailed view of the circled region of FIG. 2 and demonstrates the components of pivoting carriage assembly 116. As shown in FIG. 3A, this region includes a carriage mounting plate 332; a door mounting plate 334; and a pin connector 336. FIG. 3A shows a close-up view of pivoting carriage assembly 116 to illustrate how the components of 300A sit with respect to each other inside an exemplary door assembly. For example, upper track 112 can be shaped to receive carriage wheels 226 such that carriage wheels 226 can slide along upper track 112. A door mounting plate 334 can connect door panel 105 to a carriage mounting plate 332 via mounting brackets 102. Carriage mounting plate 332 can couple door mounting plate 334 to carriage base 224 such that carriage base always moves synchronously with door frame 105.

Figure 3B:
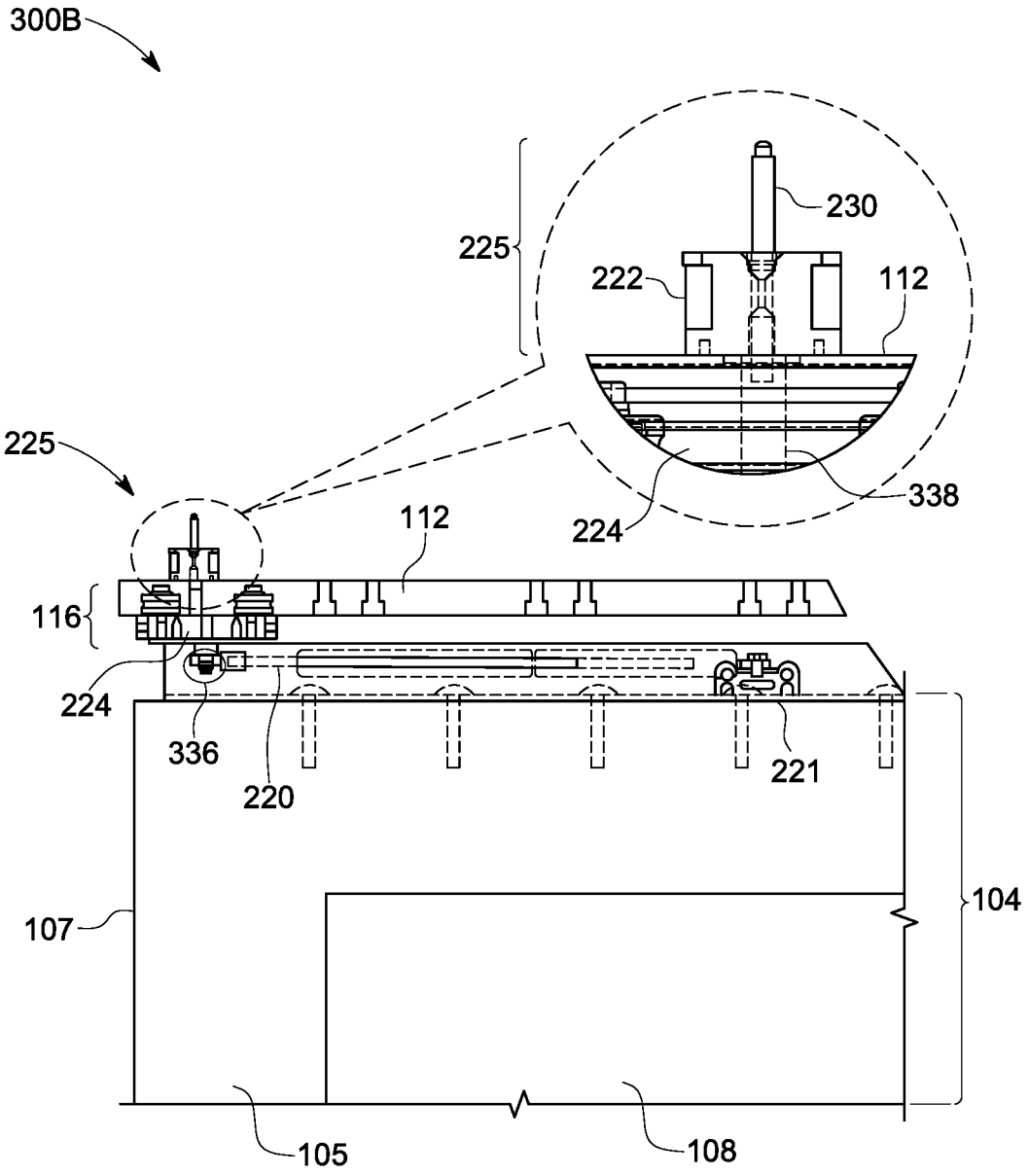
FIG. 3B shows an exemplary first carriage assembly configured to slide, in accordance with an exemplary embodiment of the present disclosure.

FIG. 3B shows an assembly 300B, detailing the components of pivoting carriage assembly 116 with a close-up view in the circled region of an exemplary locking mechanism in an unlocked configuration. Assembly 300B can include similar components with corresponding labels to carriage and lock assembly 300A and can additionally include a receiving sleeve 338. The circled region shows how rod 230 can be configured to slide through linear actuator 222 into a receiving sleeve 338. FIG. 3B shows an unlocked configuration of assembly 300A where pivoting carriage assembly 116 is configured to slidably move along upper track 112. FIG. 3B additionally demonstrates how pivot mechanism 220 extends along a top portion 321 of door frame 105.

In some examples, pivot mechanism 220 can further act as a locking feature. For example, pivot mechanism 220 can go fully into the door 104 until the door 104 is hinged open. In some examples, pivot mechanism 220 can have a latch (not pictured) inside the door frame 104 which can act as an additional safeguard and configure door 104 for swinging. This latch can further secure the door 104 in place so that the door 104 does not swing in response to wind or air pressure.

Figure 3C:
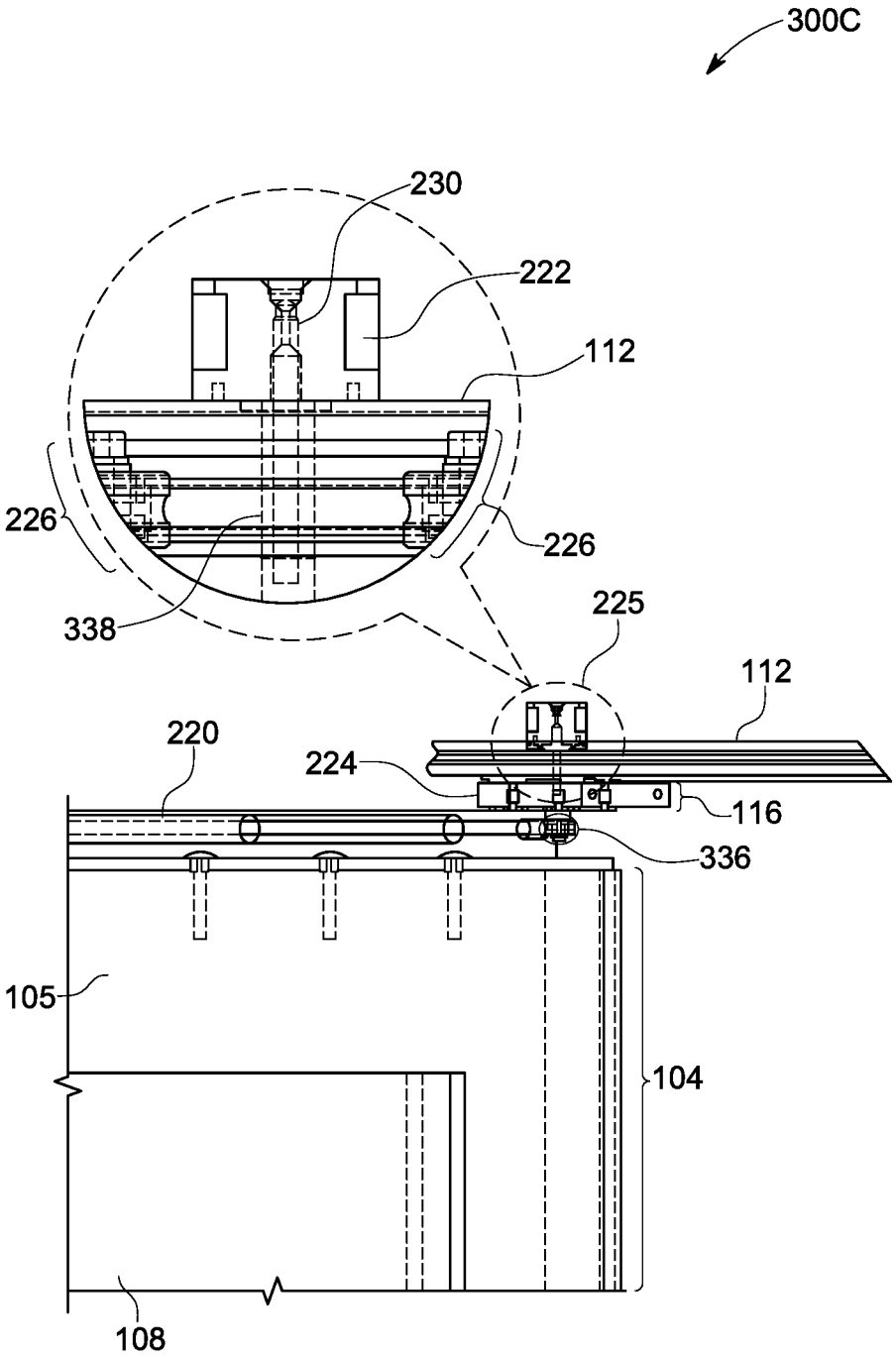
FIG. 3C shows an exemplary first carriage assembly configured to pivot, in accordance with an exemplary embodiment of the present disclosure.

FIG. 3C shows an assembly 300C detailing the components of pivoting carriage assembly 116 with a cutaway view in the circled region of an exemplary locking mechanism in a locked configuration. FIG. 3C illustrates how rod 230 extends into linear actuator 222 and into carriage base 224 when locked. Therefore, pivoting carriage assembly 116 is coupled to linear actuator 222 and can no longer slide along upper track 112. If door frame 105 were then pulled by a pull-type handle (discussed earlier with respect to FIG. 1B), door frame 105 can consequently pivot about fixed-axis 103.

Figure 4A:
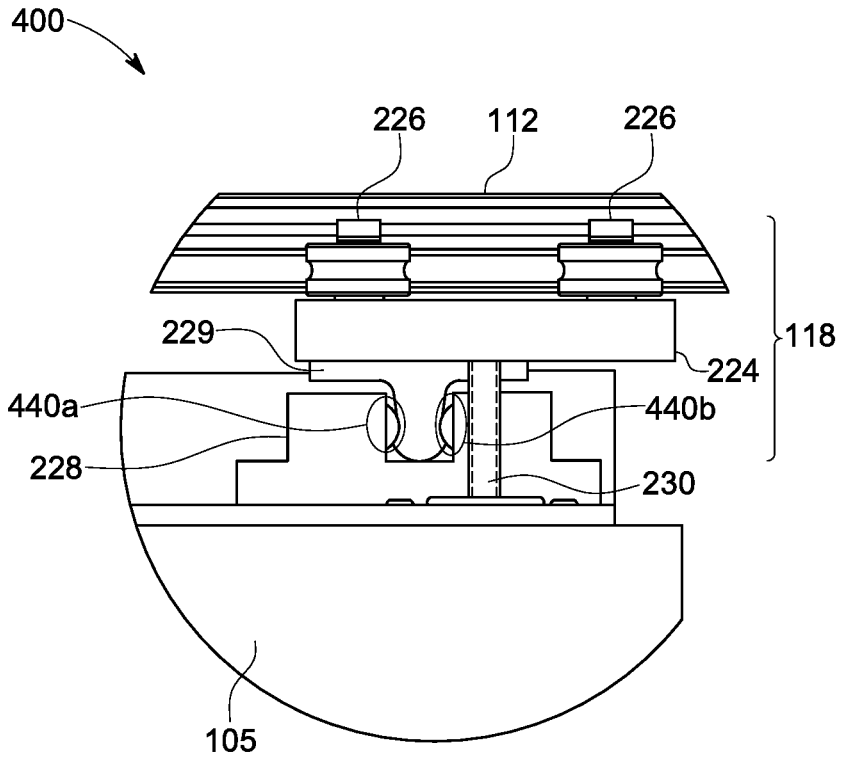
FIG. 4A shows an exemplary second carriage assembly for slidable movement, in accordance with an embodiment of the present disclosure.

FIG. 4A shows an assembly 400 of the functionality of a sliding carriage assembly 118 interacting with an exemplary locking mechanism in a locked configuration. Assembly 400 can include similar components with corresponding labels to door apparatus 200A of FIG. 2 and can additionally include detents 400*a* and 400*b*. Sliding carriage assembly 118 can include a carriage base 224 connected to a striker 229. Striker 229 can be shaped to connect with a receiving element 228. For example, receiving element 228 can have detents 440*a* and 440*b* shaped to secure striker 229. For example, when door frame 105 is pushed closed, striker 229 can slide between detents 440*a* and 440*b*. Striker 229 can then securely connect door frame 105 to sliding carriage assembly 118 and allow for door frame 105 to slide along upper track 112. Detents 440*a* and 440*b* can have a spring mechanism (not pictured) inside the detent to allow detents 440*a* and 440 to slightly adjust during in response to pressure from striker 229. The spring mechanisms can further provide an elastic force to engage with and secure striker 229 when sliding carriage assembly 118 is in a sliding configuration.

FIG. 4A also demonstrates a locking mechanism as shown by rod 230. Rod 230 can extend from door frame 105 and connect to carriage base 224. When rod 230 is connected as such, door frame 105 is locked to sliding carriage assembly 118, and can move synchronously with sliding carriage assembly 118 along upper track 112.

Figure 4B:
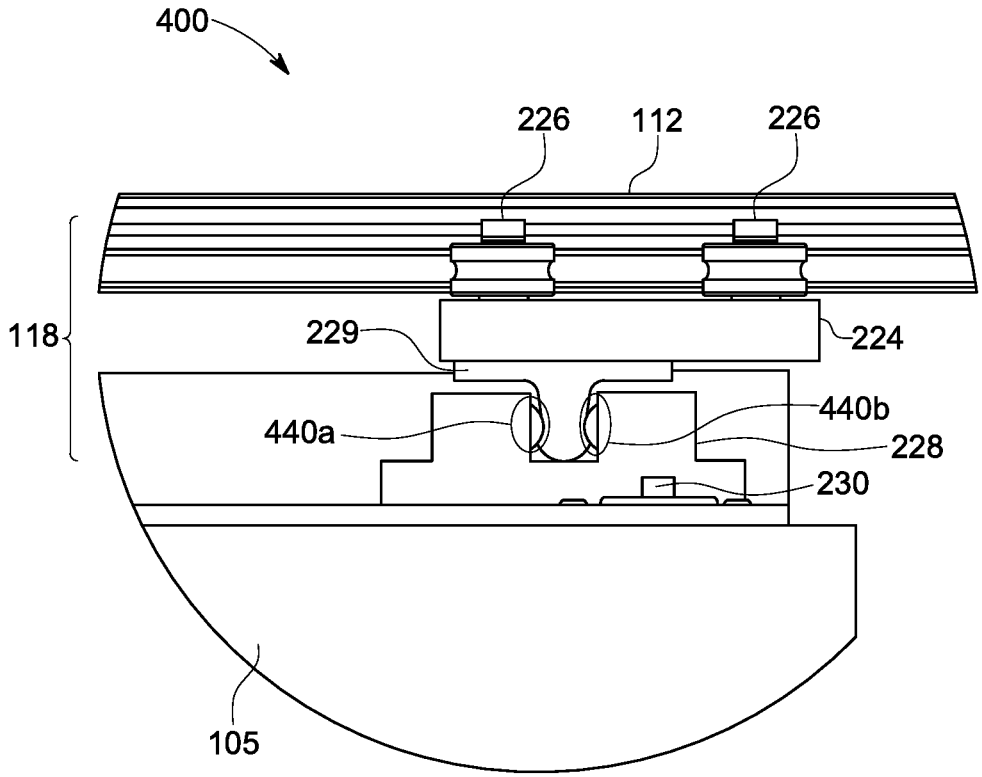
FIG. 4B shows exemplary second carriage assembly configured to pivot, in accordance with an embodiment of the present disclosure.

FIG. 4B shows assembly 400 in an unlocked configuration. FIG. 4B illustrates how rod 230 can retract entirely into door frame 105. In such a position, door frame 105 can be pulled out such that striker 229 slides out of detents 440*a* and 440*b*. Door frame 105 can then pivot as shown in FIGS. 1B, 2A, and 3C.

FIGS. 4A-4B show two possible configurations of a first carriage for operation of a door assembly. A locked position allows each door panel to slide along upper track 112 while an unlocked position allows each door panel to pivot about a fixed-axis. A user can transition between these two configurations by manually locking or unlocking the lock assembly. Furthermore, assembly 400 can located at an interior portion of a door panel while assembly 300 can be located at an exterior portion of a door panel, as shown in FIGS. 1B and 1C. Assembly 300 and assembly 400 can be configured to operate cooperatively such that both assemblies 300 and 400 are in sliding configurations or both assemblies are in pivoting configurations. In some examples, when a user transitions one of the two assemblies to a different configuration, the remaining assembly can automatically transition as well.

Figure 5:
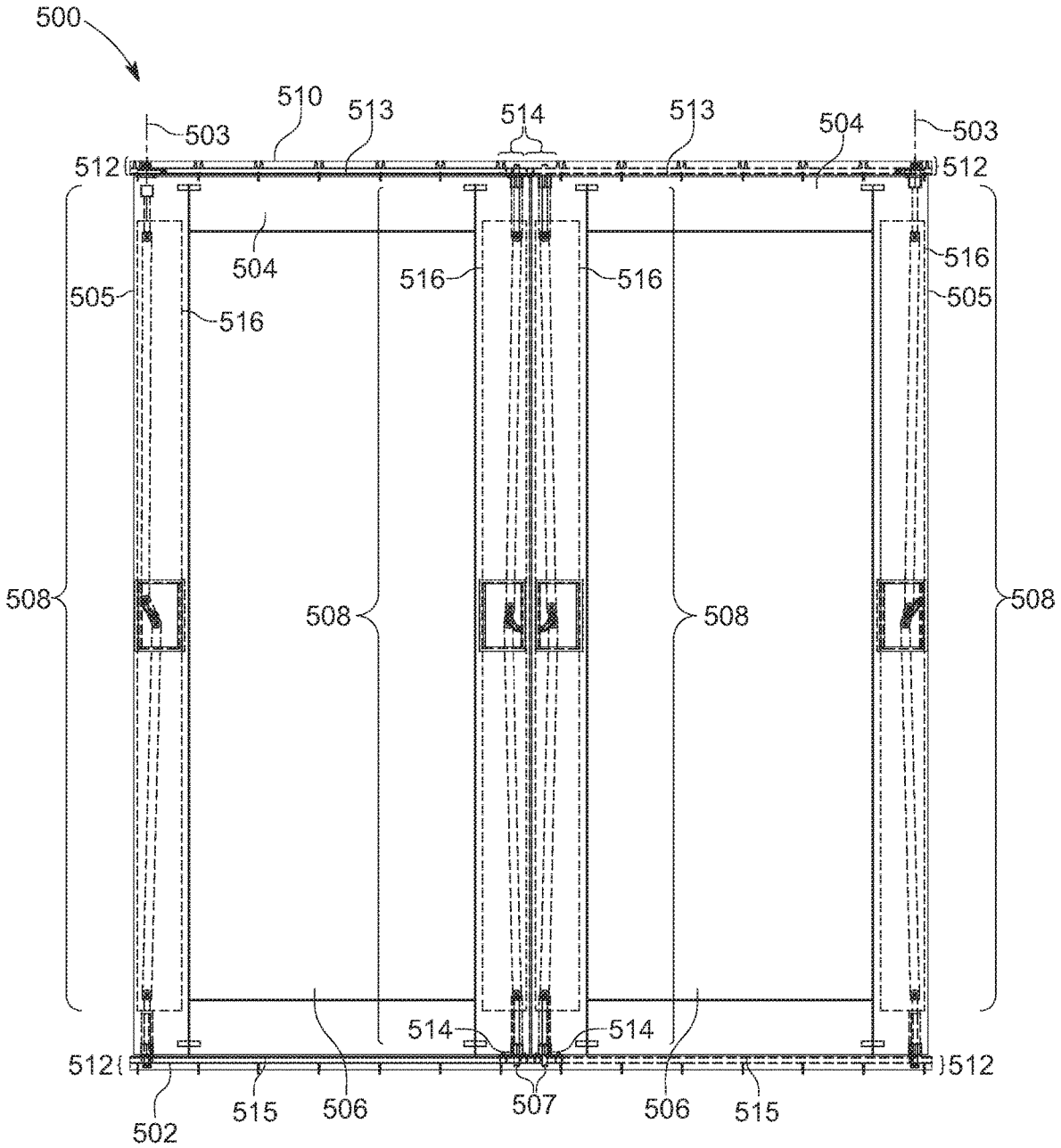
FIG. 5 shows an exemplary door apparatus, in accordance with an embodiment of the present disclosure.

FIG. 5 shows an exemplary door assembly 500, according to a second embodiment of the present disclosure. Assembly 500 can include a lower track 502; door frames 504; light transmitting panes 506; handle apparatuses 508; an upper track 510; pivoting carriage assemblies 512; sliding carriage assemblies 514; and door panel 516. Door frames 504 can have light transmitting panes 506 and handle apparatuses 508. Door frames 504 can be configured to slidably move along upper track 510 and lower track 502. Slidable movement can occur via pivoting carriage assemblies 512 and sliding carriage assemblies 514 connected to an exterior edge 505 and an interior edge 507, respectively. Door frames 504 can be further configured to pivot about a fixed-axis 503 along an exterior edge 505 of door frames 504. Slidable and pivoting movement can occur when carriage assemblies 512 and 514 are configured appropriately. For example, an unlocked pivoting carriage assembly 512 can allow a door frame 504 to slide along tracks 502 and 510 while a locked pivoting carriage assembly 512 configures door frames 504 to rotate about fixed-axis 503. This is discussed further with respect to FIGS. 7A-8B.

As shown in FIG. 5, assembly 500 can include a handle apparatus 508 inside a door panel 516 of a door frame 504. An exemplary handle apparatus 508 is discussed further with respect to FIG. 6. Referring back to FIG. 5, assembly 500 demonstrates how a pivoting carriage assembly 512 along a top portion 513 of a door frame 504 can operate synchronously with a pivoting carriage assembly 512 along a bottom portion 515 of a door frame 504. Similarly, a sliding carriage assembly 514 along a top portion 513 of a door frame 504 can operate synchronously with a sliding carriage assembly 514 along a bottom portion 515 of a door frame 504. The handle apparatus 508 can coordinate this synchronous movement.

Figure 6:
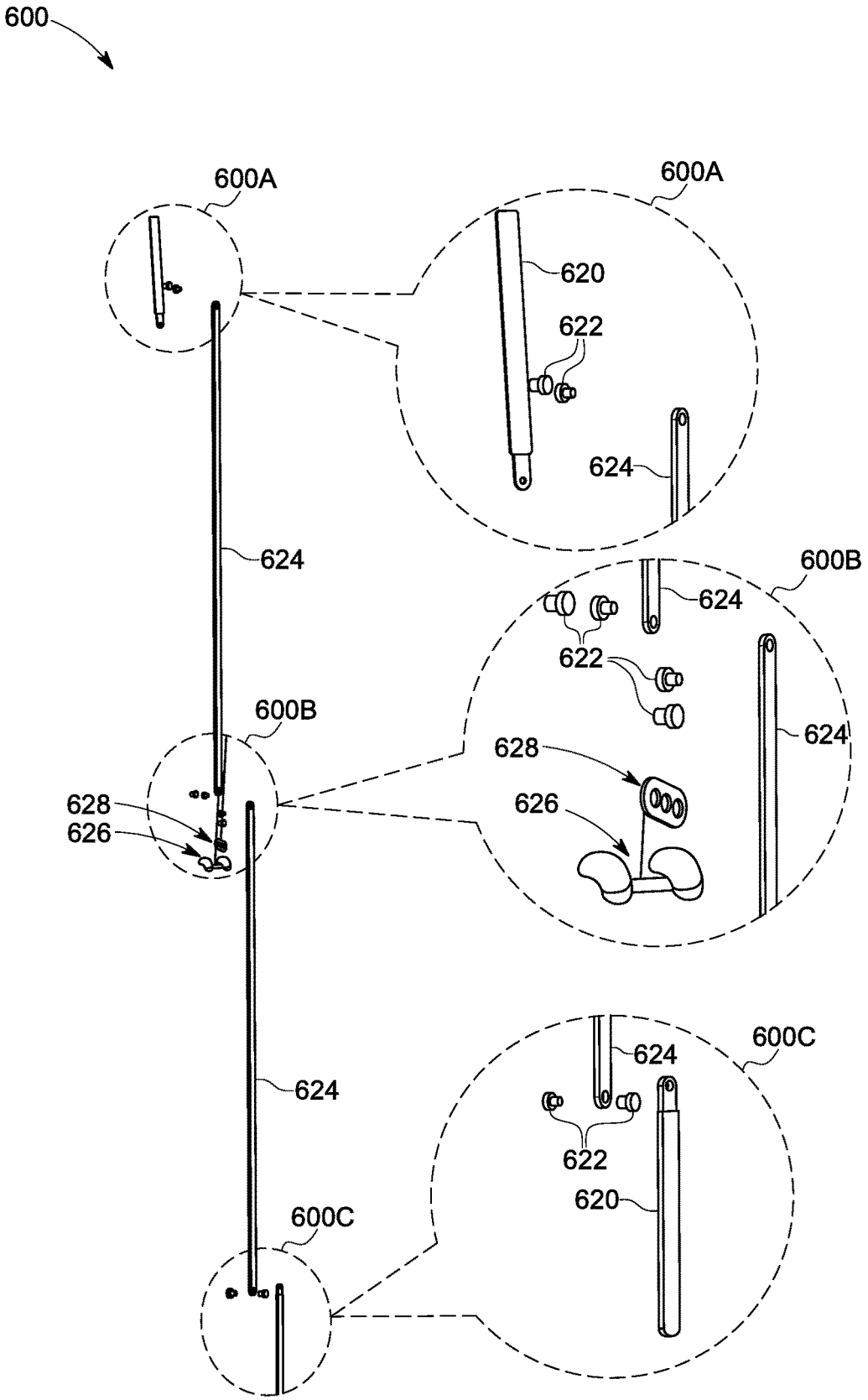
FIG. 6 shows an exemplary hinge-pin system of the door apparatus of FIG. 5, in accordance with an embodiment of the present disclosure.

FIG. 6 shows an exemplary handle system 600 which can be placed within a door panel of a door assembly (as shown by handle apparatus 508 of FIG. 5). System 600 can include coupling rods 620; screws 622; a connecting rod 624; a handle apparatus 626; and a handle mounting plate 628. Screws 622 can connect various components of system 600. For example, screws 622 can connect coupling rods 620 to connecting rods 624. Coupling rods 620 can be shaped and sized to slide through a carriage assembly and be received by a locking mechanism (shown further with respect to FIGS. 7A-7C). Referring back to FIG. 6, system 600 can have a handle apparatus 626 connected to connecting rods 624 via a handle mounting plate 628 and screws 622.

Handle apparatus 626 can thus pull a connecting rod 624 located above handle apparatus 626 downward such that a coupling rod 620 located above handle apparatus 626 retracts from a carriage assembly and locking mechanism. At the same time as that movement, handle apparatus 626 can pull a connecting rod 624 located below handle apparatus 626 upwards such that a coupling rod 620 also retracts from a carriage assembly and locking mechanism. Therefore, a carriage assembly and locking mechanism located at a top portion of a door panel can be operate simultaneously with a carriage assembly and locking mechanism located at a bottom portion of a door panel. This synchronous, or cooperative, movement can be manually controlled by a user operating handle apparatus 626.

Figure 7A:
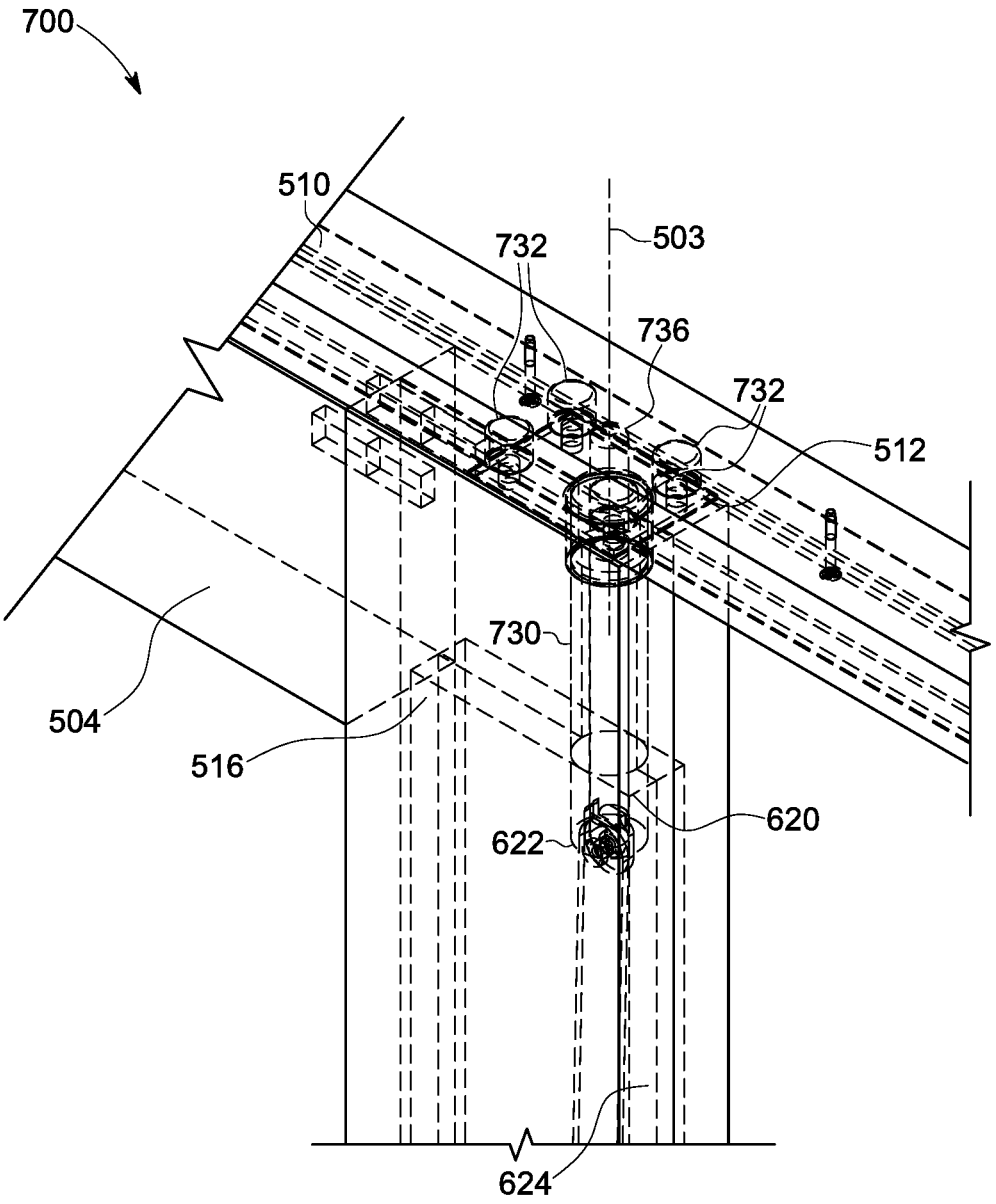
FIG. 7A shows a cut-away view of an exemplary carriage assembly configured to pivot, according to an embodiment of the present disclosure.
Figure 7B:
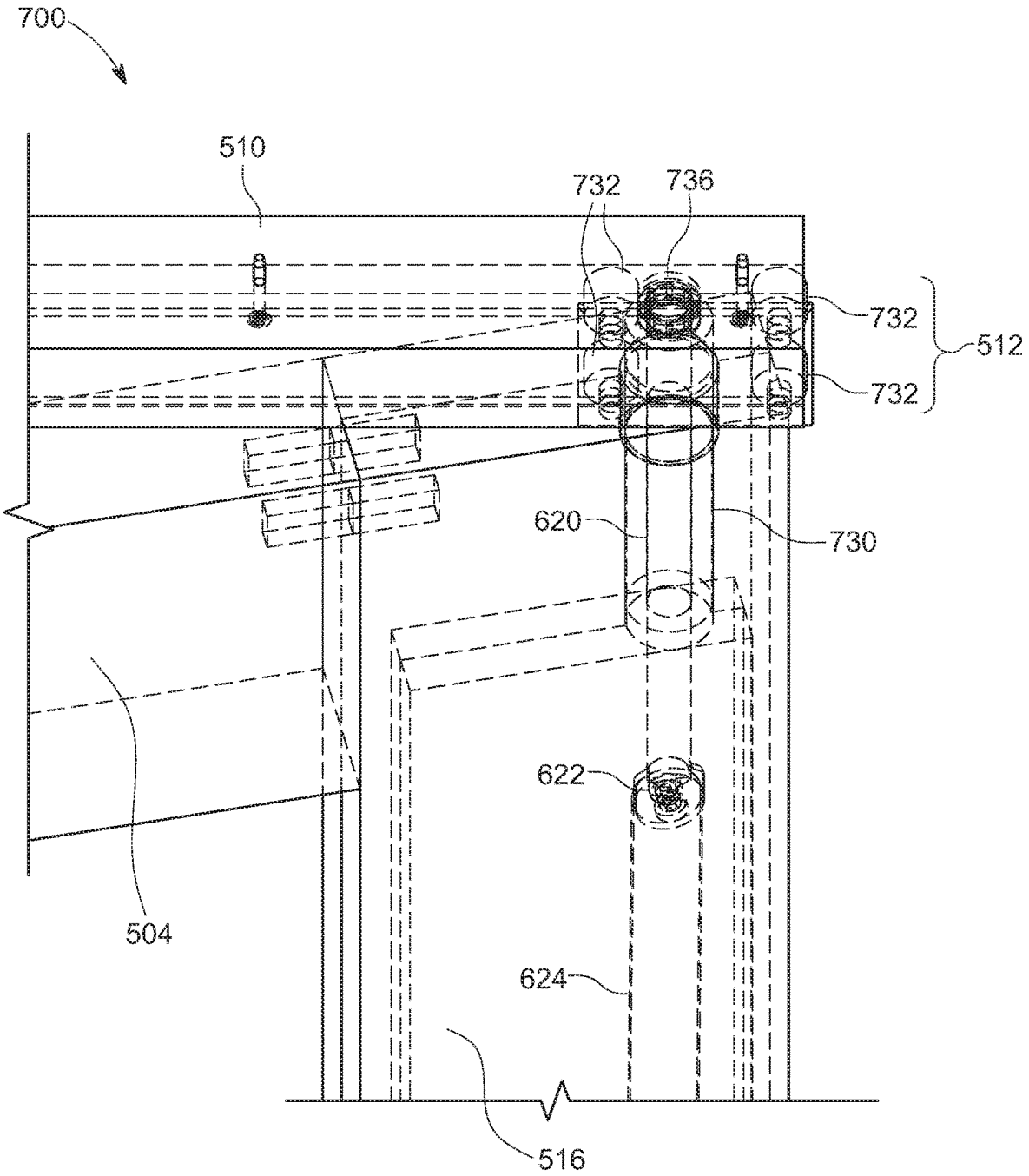
FIG. 7B shows a pivoting door frame with the carriage assembly of FIG. 7A, according to an embodiment of the present disclosure.
Figure 7C:
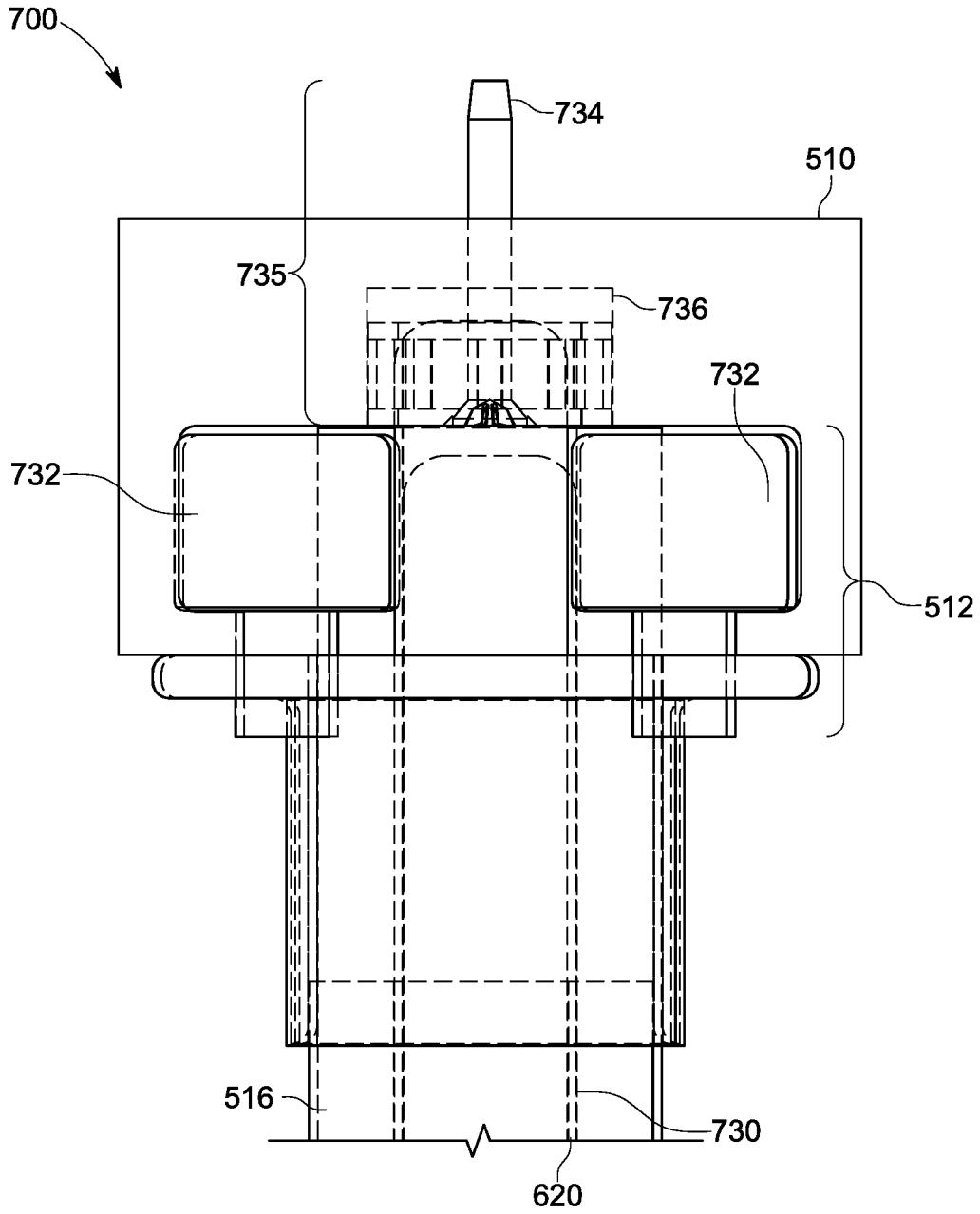
FIG. 7C shows a side view of an exemplary carriage assembly, according to an embodiment of the present disclosure.

FIGS. 7A-7C show an exemplary pivoting carriage and lock assembly 700 which can optionally pivot around a fixed-axis or slide laterally. Assembly 700 can include similar components with corresponding labels to assembly 500 and system 600 and can additionally include a receiving sleeve 730; wheels 732; locking rod 734; locking mechanism 735; and a stopping element 736.

FIG. 7A shows a cut-away view of a carriage and lock assembly 700. A receiving sleeve 730 can be configured to receive a coupling rod 620 such that coupling rod 620 slides through receiving sleeve 730 when caused to move by a handle apparatus. FIG. 7A shows that coupling rod 620 can extend into an upper track 510. This extension into upper track 510 prevents assembly 700 from sliding along upper track 510 and instead configures assembly 700 to pivot about coupling rod 620.

FIG. 7B shows a cut-away view of assembly 700 where a stopping element 736 can be seen as a door panel 504 pivots away from an upper track 510. Stopping element 736 can receive coupling rod 620 when assembly 700 is configured to extend through pivoting carriage assembly 512. Coupling rod 620 can extend through door frame 504 into pivoting carriage assembly 512 to secure pivoting carriage assembly 512 to door frame 504 such that the two components move in tandem. Thereby, door frame 504 can be configured to pivot about fixed axis 503.

FIG. 7C shows a cut-away view of assembly 700 where an interior view of a locking mechanism 735 can be shown. Locking mechanism 735 can include a stopping element 735 and a locking rod 734. Rod 734 can be connected to coupling rod 620 such that locking rod 734 extends through stopping element 736 when assembly 700 is in a pivoting configuration. For example, when coupling rod 620 pushes up through receiving sleeve 730 into pivoting carriage assembly 512, coupling rod 620 can slide through pivoting carriage assembly 512 until coupling rod 620 hits stopping element 736. This position can thereby prevent carriage assembly 512 from moving along track 510. Thereby, door 504 can pivot about coupling rod 620.

In some examples, receiving sleeve 730 can be configured to protect the material of the door 504 from the sliding up and down movement of locking rod 734. For example, receiving sleeve 730 can be a nylon sleeve. Additionally, stopping element 736 can be a cap inside the track, configured to stop upward movement of coupling rod 620.

Figure 8A:
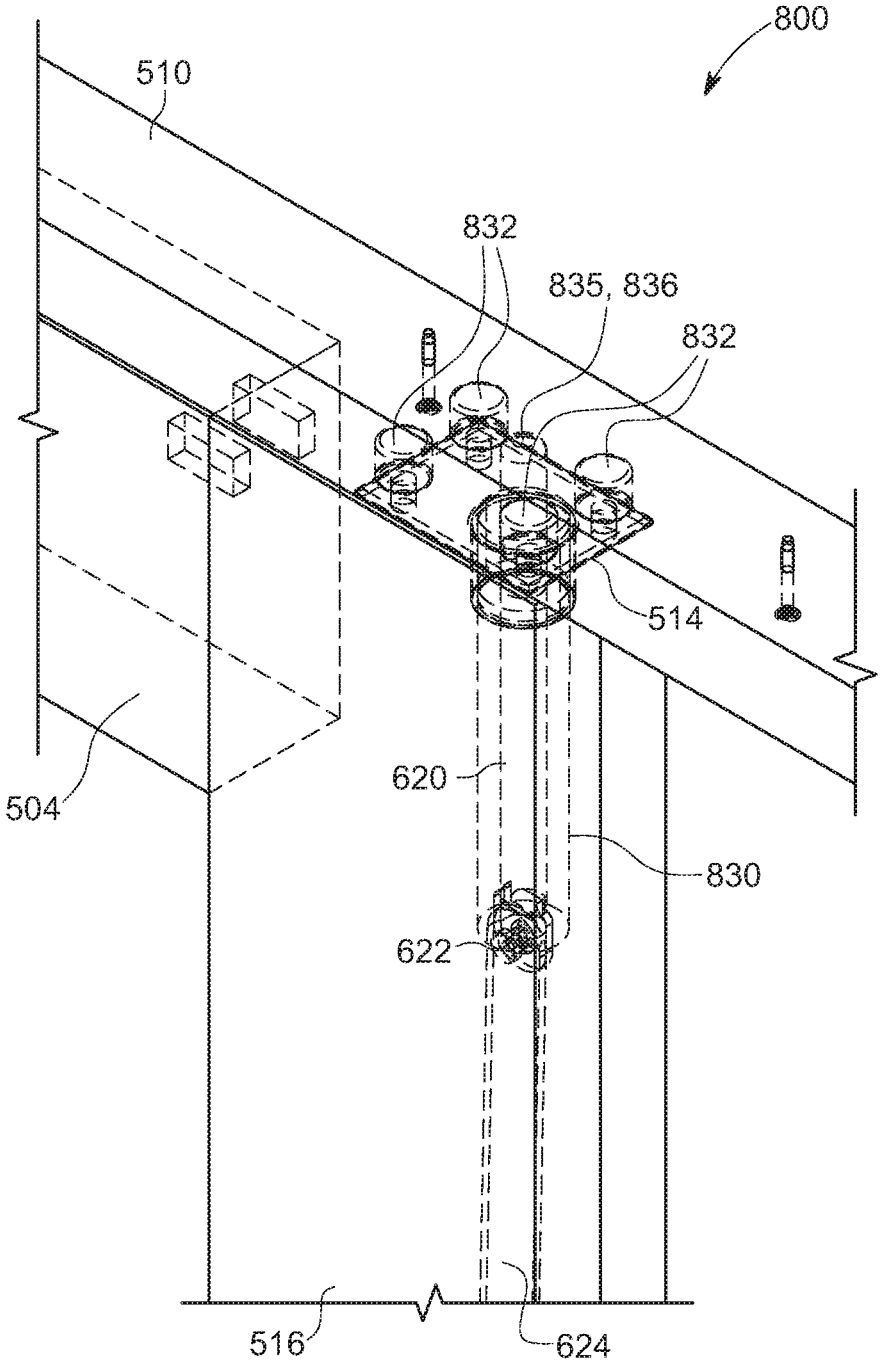
FIG. 8A shows a cut-away view of an exemplary carriage assembly configured to slide, according to an embodiment of the present disclosure.
Figure 8B:
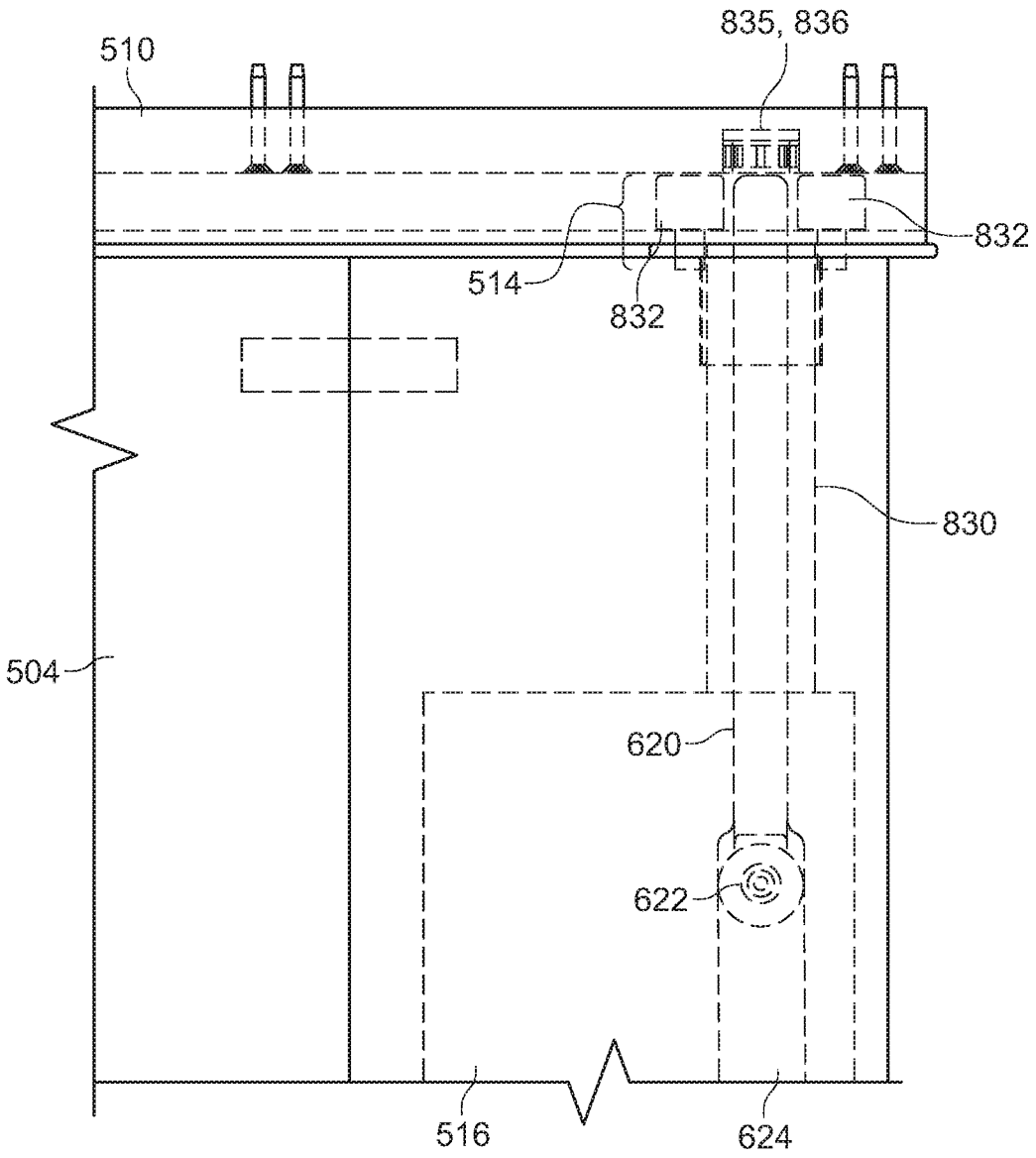
FIG. 8B shows a front view of an exemplary carriage assembly configured to slide, according to an embodiment of the present disclosure.

FIGS. 8A-8B show an exemplary carriage and lock assembly 800 configured to slide along a track. Assembly 800 can include similar components with corresponding labels to assembly 500 and system 600 and can additionally a receiving sleeve 830; wheels 832; locking mechanism 835; and a stopping element 836. FIG. 8A shows that coupling rod 620 can extend into an upper track 510. This extension into upper track 510 locks door panel 504 into sliding carriage assembly 514. Consequently, door panel 504 can slidably move along upper track 510 via sliding carriage assembly 514. FIG. 8B shows a cutaway view of a front perspective of assembly 800 where coupling rod 620 extends through sliding carriage assembly 514 to contact stopping element 836. Stopping element 836 thereby holds coupling rod 620 stably in place while assembly 800 is in a sliding configuration.

Figure 9A:
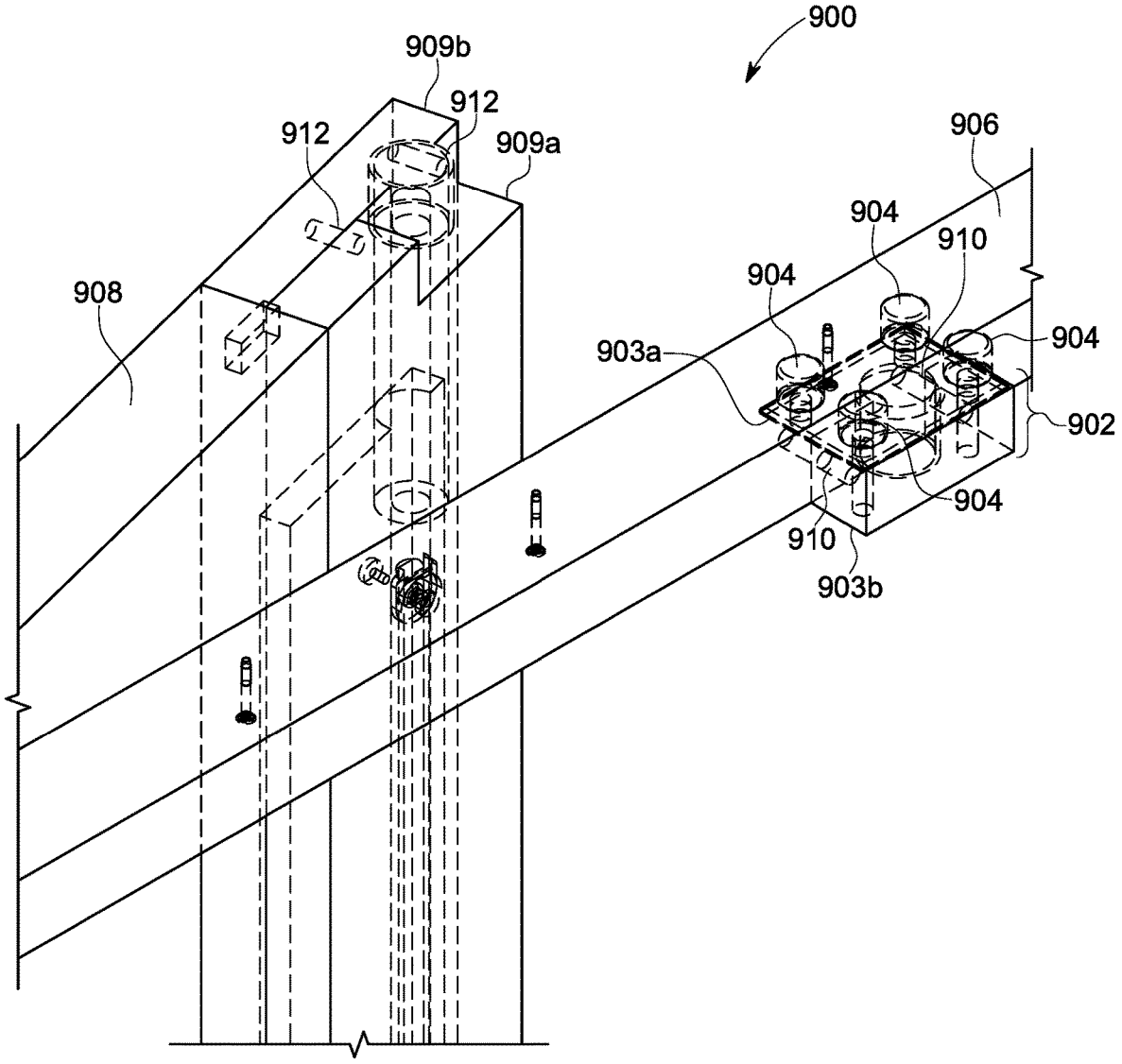
FIGS. 9A-9B show an exemplary carriage assembly configured to slide, according to an embodiment of the present disclosure.
Figure 9B:
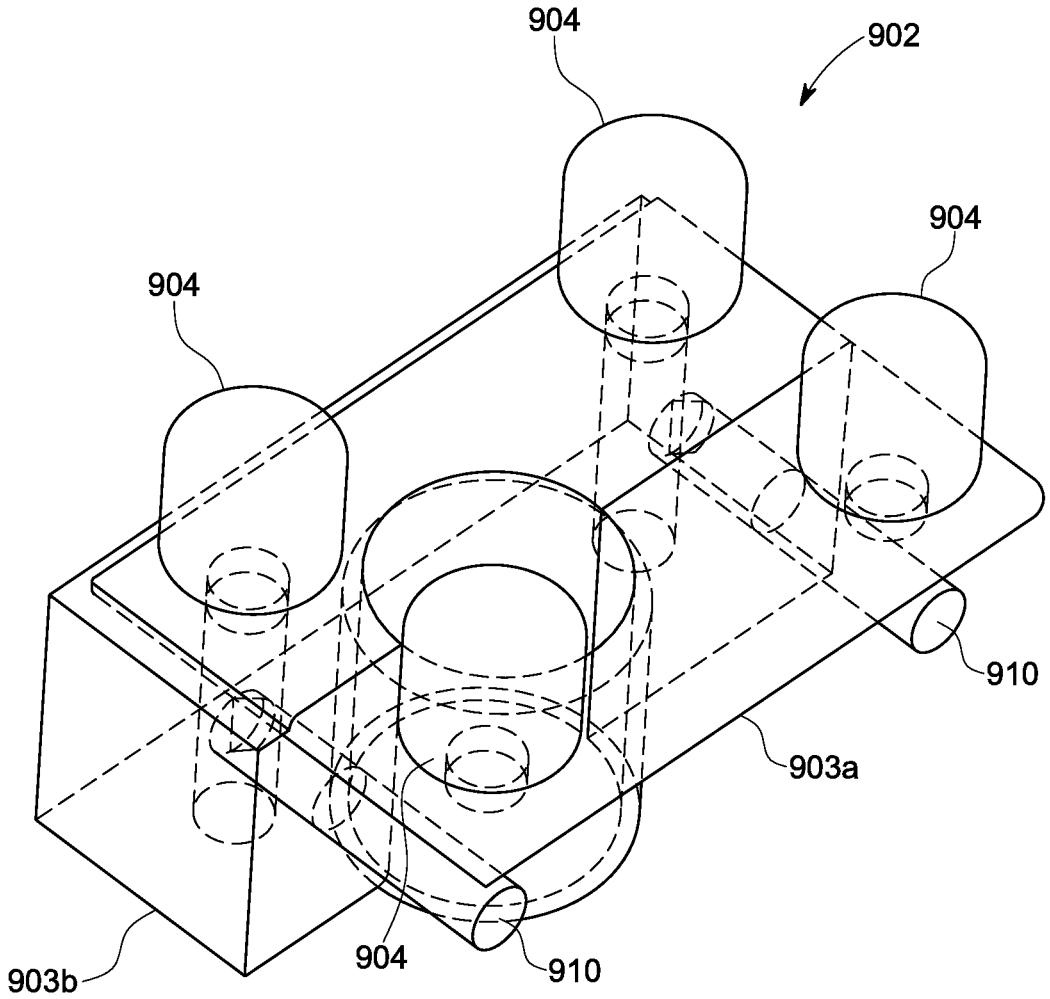

FIGS. 9A-9B demonstrate an additional carriage and lock assembly 900 configured to slide along a track. Assembly 900 can be used in either the first or second embodiment. Assembly 900 can include a carriage body 902; carriage wheels 904; track 906; door 908; connector pins 910; and receiving holes 912. Carriage body 902 can have a two-tier configuration such that a first portion 903*a* is higher than a second portion 903*b*. Second portion 903*b* can have at least one connector pin 910 extending from second portion 903*b* towards first portion 903*a*. Connector pin 910 should not extend beyond an edge of first portion 903*a*. Although two connector pins 910 are shown in FIG. 9, any number of connector pins 910 can be used so long as there is at least one connector pin 910.

Connector pins 910 can be received by corresponding receiving holes 912 inside a door 908. Door 908 can have a two-tier structure corresponding to the shape of carriage body 902. For example, an edge of door 908 can have a first portion 909*a* which is lower than a second portion 909*b*. The receiving holes 912 can be on a side surface of second portion 909*b* which faces the carriage body 902. The first portion 909*a* of door 908 can fit flush against second portion 903*b* of carriage body 902. The second portion 909*b* of door 908 can fit flush against first portion 903*a* of carriage body 902. Therefore, the connector pins 910 of the carriage body 902 can mate with the corresponding receiving holes 912 when the door 908 is in a sliding configuration. In a pivoting configuration, connector pins 910 can easily snap out of receiving holes 912 to allow door 908 to swing freely.

In some examples of the present disclosure, a user can switch between a pivoting configuration and a sliding configuration of the door assembly by interacting with an electronic display. The electronic display can coordinate with the door to lock or unlock the respective locking mechanisms according to which configuration the user selects. In other examples, the present disclosure can provide for a mechanical switch on the door panels or on the carriage and lock assemblies. In other examples, a user can change a configuration of the door assembly by means of a wirelessly transmitted device or a smartphone application on an electronic device.

For example, a user can press a button on an electronic device to put the door assembly in a pivoting configuration. The door assembly can then automatically lock the locking mechanisms above the pivoting carriage assemblies on an exterior portion of the door assembly and automatically unlock the locking mechanisms above the sliding carriage assemblies on an interior portion of the door assembly. Consequently, a user can pull interior handles and the door panels pivot about a fixed axis 103.

If the user presses a button on an electronic device to put the door assembly in a sliding configuration, the door assembly can automatically unlock locking mechanisms above the pivoting carriage assemblies and lock the locking mechanisms above the sliding carriage assemblies. Consequently, a user can pull on any handles on the door assembly to slide the door assembly across an upper and/or lower track.

In another example of the present disclosure, a user can press a button or flip a switch (or any other mechanical apparatus on a door) to put the door assembly in either a pivoting or sliding configuration. For example, there can be one switch for the pivoting configuration and a second switch for the sliding configurations. In some examples, there can be a single switch which alternates between the pivoting and sliding configurations.

While various examples of the present invention have been described above, it should be understood that they have been presented by way of example only, and not limitation. Numerous changes to the disclosed examples can be made in accordance with the disclosure herein without departing from the spirit or scope of the invention. Thus, the breadth and scope of the present invention should not be limited by any of the above described examples. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

The terminology used herein is for the purpose of describing particular examples only and is not intended to be limiting of the invention. As used herein, the singular forms "a," "an," and "the" are intended to include the plural forms as well, unless the context clearly indicates otherwise. Furthermore, to the extent that the terms "including," "includes," "having," "has," "with," or variants thereof, are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. Furthermore, terms, such as those defined in commonly used dictionaries, should be interpreted as having a meaning that is consistent with their meaning in the context of the relevant art and will not be interpreted in an idealized or overly formal sense unless expressly so defined herein.

What is claimed is:

1. A door assembly, comprising:

a door with a first end and second end opposite the first end;

a first track facing the first end;

a first carriage assembly that is slidably movable on the first track, the first carriage assembly including a first pivot mechanism that pivotably couples the door to the first track;

a second carriage assembly that is slidably movable on the first track;

a first locking mechanism to enable the door to transition between a sliding configuration and a pivoting configuration, wherein the first locking mechanism mechanically couples the door to the second carriage assembly in the sliding configuration and mechanically decouples the door from the second carriage assembly in the pivoting configuration; and a second locking mechanism configured for selectively fixing a position of the first carriage assembly in the first track, wherein the second locking mechanism is positioned above the first track;

wherein the pivoting configuration enables the door to pivot freely about the first pivot mechanism.

2. The door assembly of claim 1, wherein the first pivot mechanism comprises a hinge pin pivotably coupling the first carriage assembly and the door.

3. The door assembly of claim 2, wherein the hinge pin extends from the first carriage mechanism towards the door, and further comprising:

a mounting bracket mechanically coupled to the door and having a pin connector for receiving the hinge pin.

4. The door assembly of claim 1, wherein the second locking mechanism comprises a rod and a linear motion device for positioning the rod for the sliding configuration and the pivoting configuration, wherein the linear motion device positions the rod to extend through the first track and the first carriage assembly for the pivoting configuration, and wherein the linear motion device positions the rod so as to be retracted from the first carriage assembly for the sliding configuration.

5. The door assembly of claim 1, wherein the second locking mechanism is manually operated.

6. The door assembly of claim 1, wherein the first locking mechanism comprises a rod positionable to extend through the door and second carriage assembly for the sliding configuration, and positionable to be retracted from the second carriage assembly for the pivoting configuration.

7. The door assembly of claim 1, wherein the second carriage assembly can further comprise a striker extending towards the door from a base of the second carriage assembly and the door assembly can further comprise a set of detents on the door, wherein the detents are positioned and shaped to correspond to the striker on the door, wherein the set of detents are configured to engage the striker and secure the striker for the sliding configuration.

8. The door assembly of claim 1, wherein the first locking mechanism is integrated into the door.

9. The door assembly of claim 1, wherein the first locking mechanism is manually operated.

10. The door assembly of claim 1, further comprising:

a second track facing the second end; and a third carriage assembly that is slidably movable on the second track, the third carriage assembly including a second pivot mechanism that pivotably couples the door to the second track, wherein the second pivot mechanism and the first pivot mechanism are configured to operate cooperatively.

11. The door assembly of claim 10, further comprising:

a third locking mechanism configured for selectively fixing a position of the third carriage assembly in the second track.

12. The door assembly of claim 11, wherein the third locking mechanism and the second locking mechanism operate together.

13. The door assembly of claim 10, further comprising:

a fourth carriage assembly that is slidably movable on the second track; and a fourth locking mechanism for mechanically coupling the door to the fourth carriage assembly in the sliding configuration and mechanically decouples the door from the fourth carriage assembly in the pivoting configuration.

14. The door assembly of claim 10, wherein the fourth locking mechanism and the first locking mechanism operate together.

* * * * *